US005079479A

United States Patent [19]

Weske et al.

[11] Patent Number: 5,079,479

[45] Date of Patent: Jan. 7, 1992

[54] DUAL-ENVELOPE HIGH-PRESSURE DISCHARGE LAMP WITH THERMOSTATICALLY CONTROLLED STARTING STRIP

[75] Inventors: Helmut Weske; Manfred Koenig; Klaus Kramer, all of Berlin, Fed. Rep. of Germany

[73] Assignee: Patent Treuhand Gesellschaft fur Elektrische Gluhlampen mbH, Munich, Fed. Rep. of Germany

[21] Appl. No.: 672,473

[22] Filed: Mar. 20, 1991

[30] Foreign Application Priority Data

Apr. 27, 1990 [DE] Fed. Rep. of Germany ... 9004811[U]

[51] Int. Cl.[5] ..... H01J 61/54

[52] U.S. Cl. ..... 313/594; 313/25; 313/607

[58] Field of Search ..... 313/25, 594, 607, 234

[56] References Cited

U.S. PATENT DOCUMENTS 2,284,103 5/1942 Smitley ..... 313/576 X
3,755,708 8/1973 Andesse ..... 313/15 X
4,633,135 12/1986 Akins .
4,837,477 6/1989 Dassler et al. ..... 313/25

FOREIGN PATENT DOCUMENTS 3151513 8/1982 Fed. Rep. of Germany .
0000479 1/1979 Japan ..... 313/25

*Primary Examiner*—Donald J. Yusko
*Assistant Examiner*—Ashok Patel
*Attorney, Agent, or Firm*—Frishauf, Holtz, Goodman & Woodward

[57] ABSTRACT

To eliminate a holding frame for a starting wire (20) outside of an elongated discharge vessel (1), the starting wire (20) is directly connected to one of the electrode leads (4, 5), typically niobium tubes, by a bimetal strip (21) which is, preferably, bent in stepped form or Z shape. Under cold conditions, the strip or wire (20) is in engagement with the outside of the discharge vessel (1) to assist in starting, due to its electrical connection via the bimetal strip (21) with one of the electrodes; upon heating of the lamp, the bimetal strip (21) will lift the wire (20) off engagement with the discharge vessel (1) and thus prevent deterioration thereof.

14 Claims, 2 Drawing Sheets

DUAL-ENVELOPE HIGH-PRESSURE DISCHARGE LAMP WITH THERMOSTATICALLY CONTROLLED STARTING STRIP

Reference to related patent, the disclosure of which is hereby incorporated by reference: U.S. Pat. No. 4,633,135, Akins.

FIELD OF THE INVENTION

The present invention relates to a high-pressure discharge lamp in which a discharge vessel is retained within an outer envelope or bulb, and a starting assistance strip or wire is located adjacent the discharge vessel and selectively positionable in engagement with the discharge vessel or lifted off therefrom when the temperature of the lamp increases after firing thereof.

BACKGROUND

High-pressure discharge lamps with a discharge vessel, for example made of ceramics, and a fill including sodium, mercury and a noble gas, are well known, see for example the referenced U.S. Pat. No. 4,633,135, Akins, the disclosure of which is hereby incorporated by reference. In lamps of this type, which have a very high light output per power unit, a starting or firing assistance is usually provided The starting or firing assistance usually takes the form of an elongated metallic element, such as a metal wire, strip or the like, placed against the outside of the discharge vessel. This wire is coupled to one of the electrodes. During operation of the lamp, and particularly upon extended operation, the wire may interact with the ceramics of the discharge vessel and lead to electrolysis, and the discharge vessel may then be destroyed. It has been proposed to place a bimetallic element between the current supply lead and the starting assistance strip or wire which, upon heating of bimetallic element after ignition, lifts the wire off engagement from the sodium high-pressure discharge vessel, and thus inhibits continued electrolysis.

The lamp finds continued use, primarily due to its high light output, and, since suitable combinations of the fill were found, the color characteristics of the lamp, also in part due to specific pressure relations therein, have been so improved that the lamps are used for applications which, heretofore, had been reserved only for high-pressure discharge lamps with specifically designed high color rendering indices.

The referenced U.S. Pat. No. 4,633,135, Akins, describes a lamp of this type in which a bimetallic strip has one end secured approximately in the center of the auxiliary ignition strip, the other end of the wire being secured to a frame which is located within the outer bulb or enclosure, and extending parallel to the discharge vessel This frame structure substantially increases manufacturing costs, and further requires a lamp which is substantially larger than lamps which do not have such frames. Further, the frame makes the lamp non-symmetrical, and the non-symmetrical distribution of weight therein requires a single base of the lamp at one end. The frame structure does not permit building the lamp in double-ended form, so that it can be snapped into sockets, as is customary in tubular, double-ended lamps.

THE INVENTION.

It is an object to improve lamps of the type which have a starting wire so that they do not require a holding frame for the additional starting wire and/or the bimetallic strip therefor; the additional starting structure should be simple, inexpensive, and so designed that it can be installed by automatic machinery.

Briefly, the auxiliary starting strip is coupled to a supply lead of the electrode by a bimetal strip which, preferably, is bent in essentially horizontal Z shape, one end being electrically and mechanically connected to one of the electrode supply leads at a position outside, and preferably just outside, of the discharge vessel, and the other end being electrically and mechanically connected to an adjacent end of the starting strip. The connections are preferably by welding, and since the electrode supply leads are usually comparatively massive, for example formed as niobium tubes, the bimetallic element can be readily welded thereto.

The arrangement has the advantage that the auxiliary starting strip can be assembled in the lamp easily and simply, without requiring a separate holding frame. The structure, further, can be automatically assembled and automatically welded so that the previously required hand assembly of the lamps is no longer necessary. The sodium high-pressure discharge lamp can be manufactured entirely automatically in double-ended form and, since the outer dimension of a double-ended lamp is smaller than that of a single-ended lamp, the overall dimensions for the light source can be reduced. Connection of the bimetal to the niobium tube of the current supply lead, as well as to the auxiliary starting strip, is by welding. Typically, the starting strip is made of a high melting point metal, such as molybdenum or tungsten. The bimetallic strip is made, for example, of a thermal bimetal and, preferably, bent into Z or stepped shape, in which the component having the higher thermal coefficient of expansion of the bimetallic strip is placed to face the niobium supply lead or, respectively, the discharge vessel, to be subjected to heat radiated thereby.

DRAWINGS

FIG. 1 is a side view of a sodium high-pressure discharge lamp constructed in accordance with the present invention; and FIG. 2 is a front view, rotated with respect to the side view of FIG. 1 by 90°, of the lamp of FIG. 1.

DETAILED DESCRIPTION

Figure 1:
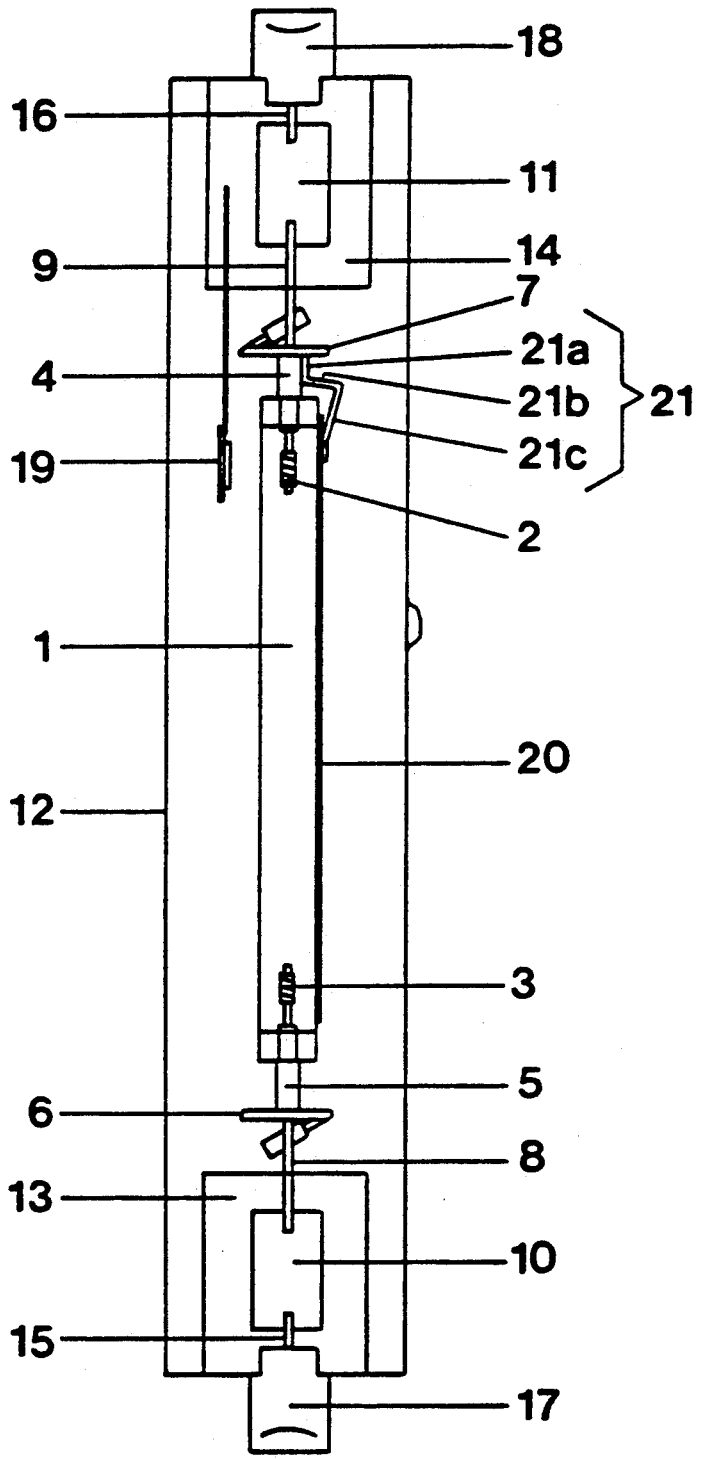
Figure 2:
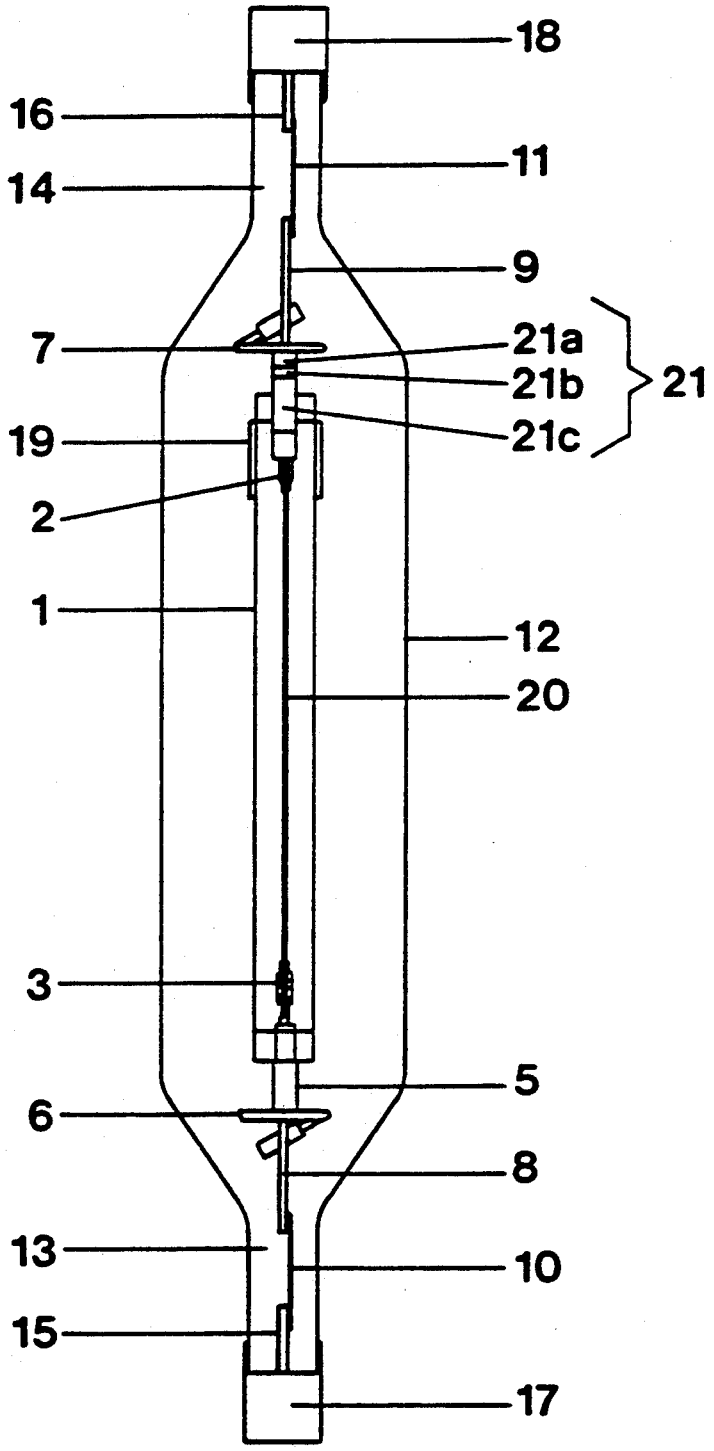

The lamp illustrated in FIGS. 1 and 2 is a double-ended sodium high-pressure discharge lamp of 70 W rating. It is formed of a circular cylindrical discharge vessel 1, made of transparent aluminum oxide ceramic. Tungsten electrodes 2, 3 are connected to current supply leads 4, 5 which are gas-tightly melted into the aluminum oxide ceramic. The current supply leads 4, 5 are formed as tubular elements made of niobium. The niobium tubes 4, 5 are connected to current supply connections 8, 9 through spring elements 6, 7. The spring elements are provided to compensate for differential expansion on heating. The current supply connections 8, 9 are coupled to molybdenum sealing foils 10, 11 of the outer envelope 12. The sealing foils 10, 11 are pinch-sealed gas-tightly into the ends of the circular cylindrical outer envelope 12 of quartz. The sealing foils 10, 11, pinch-sealed in the seals 13, 14, are in turn, for example by welding, coupled to the external supply leads 15, 16 which are located in bases 17, 18. These bases, for example, are of the standard base type R7s. A getter 19, retained by a suitable wire, is also pinch-sealed in one of the seals, i.e. 14. It is not electrically further connected to any electrode or current supply.

A starting strip or auxiliary starting wire 20 of molybdenum is located adjacent the length of the discharge vessel 1. The molybdenum wire, for example, is 50 mm long and has a thickness of 0.4 mm. One end, which is adjacent one of the ends of the discharge vessel 1, is welded to a thermal bimetal strip 21. The other end of the thermal bimetal strip 21 is welded to the niobium tube 4 coupled to the electrode 2. The thermal bimetal strip 21 has an active side made of chromium, iron and nickel, which faces the niobium tube or, respectively, the discharge vessel; and a passive side made of chromium and iron. The strip has rectangular cross section, e.g. 0.3×2 mm.

The auxiliary ignition assembly, formed by the bimetal strip 21, and the wire 20 is made by first bending the bimetal strip in a stepped configuration—see FIG. 1—having three stepped portions 21*a*, 21*b*, 21*c*. The third portion 21*c* is welded to the auxiliary ignition wire 20. The first portion 21*a* is, initially, essentially parallel to the third portion 21*c*, with the intermediate portion 21*b* forming a right angle with the respective terminal portions 21*a*, 21*c*. The first portion is then welded to the niobium tube 4. The lengths of the portions 21*a*, 21*b*, 21*c* are so determined that when wire 20 and tube 4 are welded, the auxiliary wire 20 will be parallel to tube 1 and spaced by about 0.5 mm therefrom. Thereafter, with an adjustment jig, the angle between the first section 21*a* and the second section 21*b* is increased until the auxiliary wire 20 engages tube 1 over its entire length. The section 21*c*, in this bending operation, is slightly bent adjacent the weld, in the direction of the wire 20.

A bimetal strip 21, so initially formed and then deformed, results in optimum starting assistance.

The angles between portions 21*a*, 21*b*, 21*c* will then be only generally or roughly right angles, when the lamp is cold.

Operation

When the lamp is cold, and before starting, the wire 20 is pressed against the discharge tube 1 throughout its entire length. Upon energization, and firing of the lamp, the bimetal strip 21 will heat and lift off the strip 20 completely from engagement with the discharge vessel 1.

Various changes and modifications may be made within the concept of the present invention.

We claim:

1. A dual-envelope high-pressure discharge lamp having an outer bulb (12);

an inner elongated discharge vessel (1);

electrode supply leads (4, 5) extending, respectively, through opposite ends of the discharge vessel;

electrodes (2, 3) within the vessel;

a fill including sodium, mercury and a noble gas within the discharge vessel;

an ignition starting strip means (20) extending along outside of the discharge vessel and having an end portion adjacent one (4) of the electrode supply leads (4, 5); and means for securing the starting strip means (20) in position, selectively, against the discharge vessel when the lamp is cold, or spaced from the discharge vessel when the lamp is in operation, and wherein said securing means includes a bimetal strip (23), wherein said bimetal strip (21) has one end mechanically secured and electrically connected to said one (4) of the electrode supply leads (4, 5) at a position outside of the discharge vessel, and another end mechanically secured and electrically connected to said end portion of said starting strip means (20).

2. The lamp of claim 1, wherein the bimetal strip (21) is welded to the starting strip means (20).

3. The lamp of claim 1, wherein the bimetal strip (21) is welded to said one (4) of the electrode supply leads (3, 4).

4. The lamp of claim 1, wherein at least said one (4) of the electric supply leads comprises a niobium tube element (4).

5. The lamp of claim 1, wherein the starting strip means (20) comprises a wire of high melting point metal.

6. The lamp of claim 5, wherein said starting strip means (20) comprises a wire of molybdenum; tungsten.

7. The lamp of claim 1, wherein said bimetal strip (21) is angled in step-like form, or Z form, having two roughly parallel end portions (21*a*, 21*c*), and an intermediate connecting portion forming, roughly, right angles with said end portions.

8. The lamp of claim 7, wherein one of the roughly parallel end portions (21*a*, 21*c*) of the bimetal strip (21) is welded to one of: said starting strip means (20); said one (4) of the electrode supply leads (4, 5).

9. The lamp of claim 8, wherein the starting strip means (20) comprises a wire of high melting point metal.

10. The lamp of claim 8, wherein at least said one (4) of the electric supply leads comprises a niobium tube element (4).

11. The lamp of claim 10, wherein said discharge vessel (1) comprises a ceramic tube.

12. The lamp of claim 1, wherein said outer bulb (12) comprises quartz or glass.

13. The lamp of claim 1, wherein said discharge vessel (1) comprises a ceramic tube.

14. The lamp of claim 1, wherein said electrode supply leads (4, 5) comprise niobium tubular elements (4, 5).

* * * * *